US007594298B2

(12) United States Patent
Greene

(10) Patent No.: US 7,594,298 B2
(45) Date of Patent: Sep. 29, 2009

(54) DUSTER HAVING A ROTATABLE VACUUM PICK-UP

(75) Inventor: Mason I. Greene, Auburn, AL (US)

(73) Assignee: Euro-Pro Operating, LLC, Newton, MA (US)

( * ) Notice: Subject to any disclaimer, the term of this patent is extended or adjusted under 35 U.S.C. 154(b) by 600 days.

(21) Appl. No.: 11/059,852

(22) Filed: Feb. 17, 2005

(65) Prior Publication Data

US 2006/0179605 A1 Aug. 17, 2006

(51) Int. Cl.
*A47L 5/00* (2006.01)
*A47L 9/04* (2006.01)
*A47L 9/06* (2006.01)
*A47L 5/24* (2006.01)

(52) U.S. Cl. ..... 15/377; 15/368; 15/344

(58) Field of Classification Search ..... 15/377, 15/368, 344, 400; D4/102; 200/321, 519, 200/539

See application file for complete search history.

(56) References Cited

U.S. PATENT DOCUMENTS

| | | | | |
|---|---|---|---|---|
| 500,415 | A | 6/1893 | Neal | |
| 1,764,626 | A | 6/1930 | Heckman | |
| 1,801,620 | A * | 4/1931 | Bettman | 15/344 |
| 2,078,634 | A | 4/1937 | Karlstrom | |
| 2,205,599 | A | 6/1940 | Mitchell | |
| 2,671,926 | A | 3/1954 | Minerly | |
| 2,827,060 | A * | 3/1958 | Marty | 132/212 |
| 3,060,485 | A * | 10/1962 | Butter et al. | 15/328 |
| 4,208,013 | A * | 6/1980 | Coleman et al. | 239/351 |
| 4,357,730 | A * | 11/1982 | Lex | 15/344 |
| 4,409,998 | A * | 10/1983 | Bauer | 132/227 |
| 4,454,627 | A | 6/1984 | Simm et al. | |
| 5,331,716 | A | 7/1994 | Hemmann et al. | |
| 5,379,483 | A * | 1/1995 | Pino | 15/323 |
| 5,638,945 | A * | 6/1997 | Fukinuki et al. | 200/43.17 |
| 2001/0054214 | A1 | 12/2001 | Kalman et al. | |
| 2004/0098829 | A1 * | 5/2004 | Song | 15/400 |
| 2004/0134023 | A1 * | 7/2004 | Caruso | 15/377 |

* cited by examiner

*Primary Examiner*—Bryan R Muller
(74) *Attorney, Agent, or Firm*—McAndrews, Held & Malloy, Ltd.

(57) ABSTRACT

A hand-held device for dusting a surface is disclosed. The device includes al housing, a drive motor associated with the housing, a rotating dusting element rotated about its axis by the drive motor, and at least one conduit for removing dust from the dusting element. The conduit has a first portion for attachment to a source of vacuum and a side portion extending parallel to the axis of the duster and adjacent to the duster. Optionally, the first portion of the conduit is adapted to couple to a vacuum cleaner hose to draw air and debris into the side portion and out of the first portion of the conduit. The side portion of the conduit has one or more vacuum inlets extending along the duster for drawing dirt from the duster. One or more vacuum inlets are selectively rotatable from a first position generally facing toward the duster to a second position generally facing away from the duster and providing access to the vacuum inlet independent of the duster. The device weighs less than five pounds.

15 Claims, 4 Drawing Sheets

DUSTER HAVING A ROTATABLE VACUUM PICK-UP

CROSS-REFERENCE TO RELATED APPLICATIONS

This application has subject matter related to that of U.S. application Ser. No. 10/731,976 (Published as US 2004/0134023 A1), filed Dec. 10, 2003; Ser. No. 09/963,954 filed Sep. 26, 2001; 60/235,658, filed Sep. 26, 2000; Ser. No. 60/432,185, filed Dec. 10, 2002, and Ser. No. 60/439,706 filed Jan. 13, 2003. Each application referred to in this paragraph is incorporated here by reference in its entirety to provide continuity of disclosure.

FIELD OF THE INVENTION

The present invention relates generally to tools used for maintaining and in treating surfaces and for cleaning and collecting debris from a variety of surfaces. The illustrated embodiment more particularly relates to a duster or similar tool having a mechanized dusting element.

BACKGROUND OF THE INVENTION

While there have been a multitude of tools to clean our environments there are serious limitations, as the solutions to date have been manual, limited in cleaning capacity, and lacking the advantages and efficiency that automation brings to most tasks. A mechanized duster addressing these problems is disclosed in U.S. Patent Application Publication 2004/0134023, inventor Steven Caruso, published Jul. 15, 2004, and the other patent applications incorporated by reference above.

SUMMARY OF THE INVENTION

Certain further improvements and revisions have been made to the mechanized duster disclosed in U.S. Patent Application Publication 2004/0134023.

One aspect of the invention is a hand-held device for dusting a surface. The device includes a housing, a drive motor associated with the housing, a rotating dusting element rotated about its axis by the drive motor, and at least one conduit for removing dust from the dusting element. The conduit has a first portion for attachment to a source of vacuum and a side portion extending parallel to the axis of the duster and adjacent to the duster. Optionally, the first portion of the conduit is adapted to couple to a vacuum cleaner hose to draw air and debris into the side portion and out of the first portion of the conduit.

The side portion of the conduit has one or more vacuum inlets extending along the duster for drawing dirt from the duster. One or more vacuum inlets are selectively rotatable from a first position generally facing toward the duster to a second position generally facing away from the duster and providing access to the vacuum inlet independent of the duster. The device weighs less than five pounds.

In certain embodiments the hand-held dusting device can include a rotating coupling between the first portion and the side portion of the conduit allow the side portion of the conduit to rotate about an axis extending in the axial direction relative to the first portion of the conduit. The rotating coupling can include a seal to allow a partial vacuum to be drawn to convey dust from the side portion to the first portion of the conduit.

In some embodiments the hand-held dusting device can include a switch associated with the housing for turning on the drive motor. Optionally, the operator can lock the switch in the "on" position to keep the duster rotating without actively holding the switch down.

In some embodiments, the switch mechanism comprises a trigger, an abutment, and first and second electrical contacts.

The housing captures the trigger. It is movable in a first direction between an unlocked "on" position and an "off" position, and biased toward the "off" position. It is also movable from its unlocked "on" position to a locked "on" position.

The abutment is engaged by the trigger to resist the trigger bias when the trigger is in its locked "on" position.

The first and second electrical contacts are normally biased apart. One of the contacts is operatively connected to the trigger, so it will close against the other contact (so the switch is "on") when the trigger is advanced from the "off" position to one of the "on" positions.

Another aspect of a hand held device for dusting a surface has a duster, a conduit, a housing, a cleat, and a drive motor.

The duster optionally is generally cylindrical, and has an axis of rotation, a first end, and an axially spaced second end.

The conduit extends generally parallel and adjacent to the duster. The conduit has a vacuum opening for attachment to a source of vacuum and a vacuum inlet extending along the axis of the duster for drawing dust from the duster. The conduit has an attachment area on its side.

The housing is made of first and second shell portions joined at a parting plane. The first shell portion has a cleat slot extending depthwise generally perpendicular to the parting plane.

The cleat has a first portion anchored at the attachment area and a wing portion captured in the cleat slot of the housing.

The drive motor is mounted within the housing and operatively connected with the duster to rotate the duster about its axis.

In some embodiments, the first portion of the conduit can be adapted to couple to a vacuum cleaner hose or other vacuum source to draw air and debris into the side portion and out the first portion of the conduit.

LIST OF REFERENCE CHARACTERS

Figure 1:
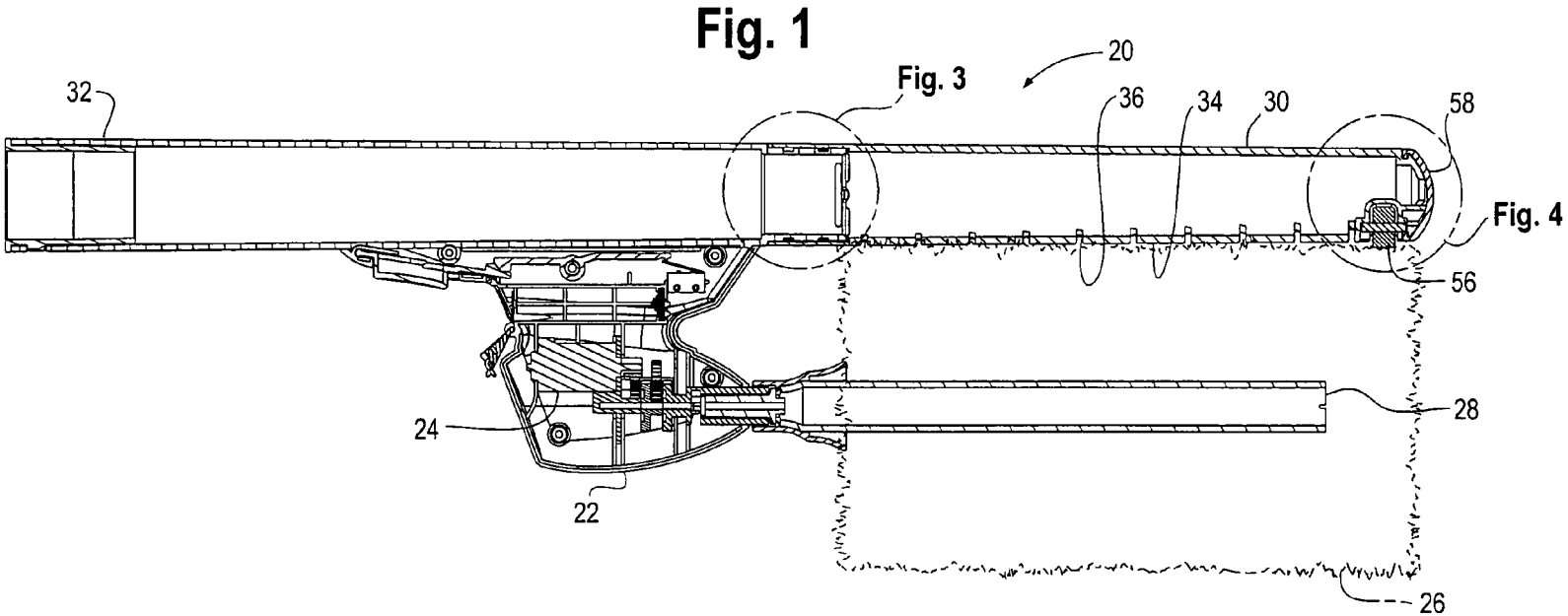
FIG. 1 is a longitudinal section of an embodiment of the present duster.

The reference characters used in the drawings are listed below; like characters indicate like parts:

20. device
22. housing
24. motor
26. duster
28. axis
30. conduit
32. first portion of 30
34. side portion of 30
36. vacuum inlet
38. rotating coupling
40. snap ring
42. sealing ring
44. groove (for 40)
46. groove (for 42)
48. detent
50. detent
52. pocket
54. pocket
56. wheel
58. end cap
60. axle (of 56)
62. switch
64. trigger
66. lever
68. lever
70. plunger
72. ramp
74. arm of 66
76. arm of 66
78. pivot
80. ramp
82. abutment
83. trigger bias spring
84. following surface of 80
86. following surface of 72
88. battery bracket
90. door
92. side opening
94. cleat
96. wing of 94
98. wing of 94
99. surface
100. shell portion
102. shell portion
104. parting plane
106. cleat slot
108. fasteners
110. reduction gear set

DETAILED DESCRIPTION OF THE ILLUSTRATED EMBODIMENT

While the invention will be described in connection with several preferred embodiments, it will be understood that the invention is not limited to these embodiments. On the contrary, the invention includes all alternatives, modifications, and equivalents as may be included within the spirit and scope of the appended claims.

The entire description and all the drawing Figures of US 2004/0134023 A1, incorporated by reference above, show various aspects of a duster or similar tool that has certain features in common with the embodiments described in this application. Features described in the application incorporated by reference are also contemplated for use in any combination with the features of the embodiments described here. The incorporated reference also shows how the dusting device may be used.

Certain further improvements and revisions have been made to the mechanized duster disclosed in U.S. Patent Application Publication 2004/0134023, as discussed below.

FIGS. 1-11 show a hand-held device for dusting a surface. The device weighs less than five pounds, in one embodiment.

Figure 2:
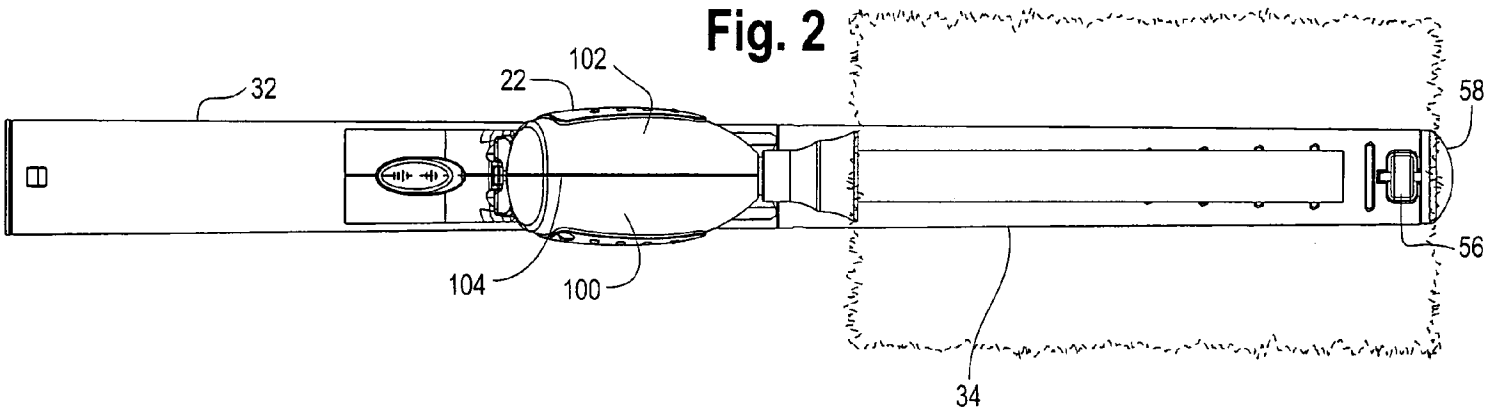
FIG. 2 is a bottom plan view of the embodiment of FIG. 1.

Referring in particular to FIGS. 1 and 2, the device 20 includes a housing 22, a drive motor 24 associated with the housing 22, a rotating duster 26, shown as generally cylindrical but optionally having a different shape, rotated about its axis 28 by the drive motor 24, and an conduit 30 for removing dust from the duster 26. The conduit 30 has a first portion 32 for attachment to a source of vacuum (not shown) and a side portion 34 extending parallel to the axis 28 of the duster 26 and adjacent to the duster 26. Optionally, the first portion 32 of the conduit 30 is adapted to couple to a vacuum cleaner hose to draw air and debris into the side portion 34 and out of the first portion 32 of the conduit 30. Alternatively, the device 20 can include a built-in vacuum motor and form, as in a handheld vacuum unit.

The side portion 34 of the conduit 30 has a vacuum inlet, here a series of vacuum inlets 36 increasing in size going distally to provide more uniform suction along the duster for drawing dirt from the duster. The vacuum inlet 36 can be selectively rotatable from a first position, as shown in FIG. 1, generally facing toward the duster to a second position (not illustrated) generally facing away from the duster and providing access to the vacuum inlet 36 independent of the duster. In this embodiment, this rotation is accomplished by rotating the side portion 34 relative to the first portion 32.

In certain embodiments the hand-held dusting device can include a rotating coupling between the first portion 32 and the side portion of the conduit 30 to allow the side portion of the conduit 30 to rotate about an axis extending in the axial direction relative to the first portion 32 of the conduit 30. The rotating coupling can include a seal to allow a partial vacuum to be drawn to convey dust from the side portion to the first portion 32 of the conduit 30.

A detent optionally can be associated with the coupling for maintaining the side portion in at least one detent position relative to the first portion 32 of the conduit 30. The detent can be configured to detent the vacuum inlet 36 of the side portion in a position generally facing toward the duster, or in a position facing generally away from the duster, or in a position facing in a direction rotationally displaced from the axis of the duster.

Figure 3:
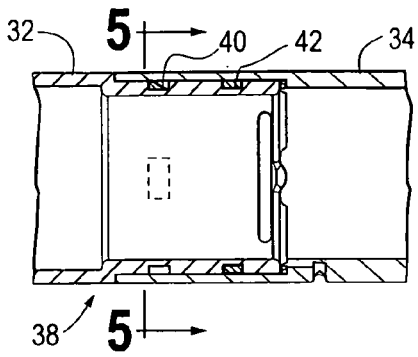
FIG. 3 is a detail view of the structure called out in FIG. 1.
Figure 5:
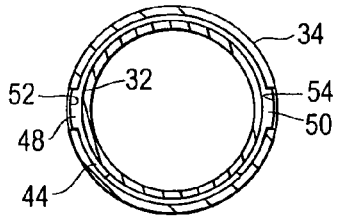
FIG. 5 is a cross-section taken along section line 5-5 of FIG. 3.
Figure 6:
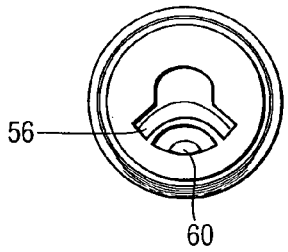
FIG. 6 is an elevation taken from the line 6-6 of FIG. 4, with the end cap removed to show underlying structure.
Figure 7:
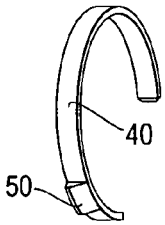
FIG. 7 is a perspective view of the snap ring of FIG. 3.
Figure 7A:
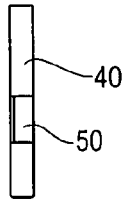
FIG. 7A is a side elevation of the snap ring of FIG. 3.
Figure 7B:
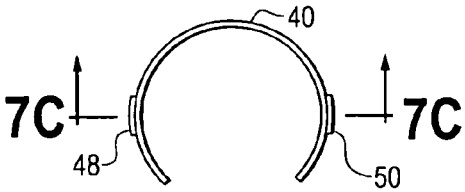
FIG. 7B is a front elevation of the snap ring of FIG. 3.
Figure 7C:
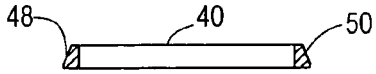
FIG. 7C is a diametric section of the snap ring of FIG. 3.
Figure 8:
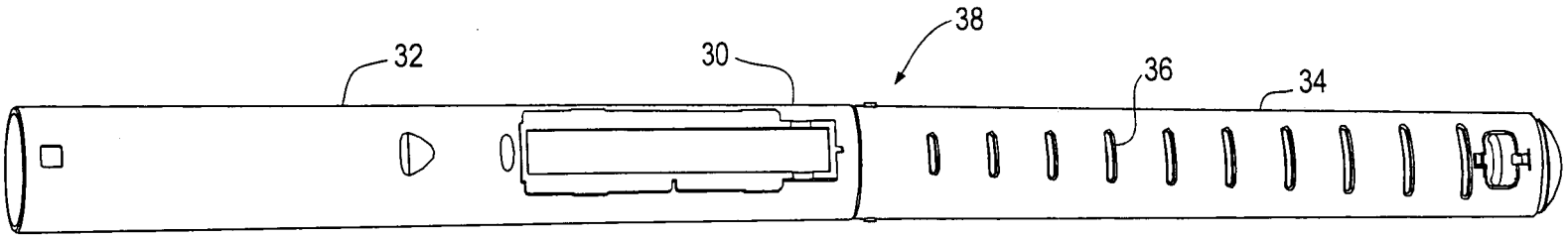
FIG. 8 is a view similar to FIG. 2, with the motor case and duster removed.

Referring particularly to FIGS. 3, 5, 7 through 7C, and 9, the rotating coupling 38 in this embodiment includes a snap ring 40 and a sealing ring 42 respectively received in the grooves 44 and 46 in the first portion 32 and, as shown in FIG. 3, engaging mating structure in the second portion 34. FIG. 5 shows the assembly of the first and second portions 32 and 34 and the snap ring 40 in section. The snap ring 40 is shown in isolation in FIGS. 7 through 7C.

The snap ring 40 has a pair of opposed detents 48 and 50 that are received in pockets 52 and 54 formed in the side portion 34 to index the vacuum inlet 36 either facing toward the duster 26, so the inlet 36 draws dirt from the duster 26, or away from the duster 26, so the inlet 36 can be used independent of the duster 26 to vacuum dust, as when an accumulation of dust on a surface is more easily removed by using a vacuum alone, or as when debris is to be picked up that is too large or heavy to pick up with the duster 26. In an alternate embodiment, not illustrated, more or fewer detents such as 48 and 50 can be provided, for example four detents at 90-degree intervals, to allow more detented positions for the vacuum inlet 36 relative to the duster 26. Alternatively or in addition, more pockets such as 52 and 54 can be provided to allow more detented positions for the vacuum inlet 36 relative to the duster 26. Additionally, the first and second portions 32 and 34 can be positioned so the detents 48 and 50 are displaced from the pockets 52 and 54, if desired.

Figure 4:
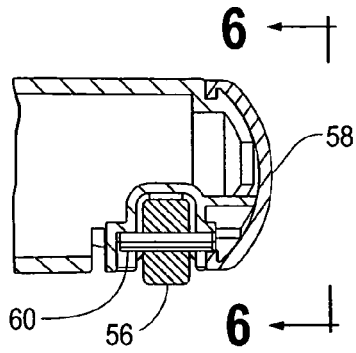
FIG. 4 is a detail view of the structure called out in FIG. 1.

In some embodiments, illustrated here in FIGS. 1, 2, and 4, the hand-held dusting device can further include a rolling element, for example a wheel 56 mounted in or near its distal end in a fixed position relative to the axially spaced second end of the duster. The wheel 56 is carried on an axle 60 and positioned to make rolling contact with a surface at or near the surface being dusted, as when dusting along a table with the vacuum inlet 36 turned away from the duster 26 so the duster 26 does not prevent contact of the wheel 56 with a table or other flat surface. The rolling element can serve to locate the duster in an effective dusting position relative to a surface being dusted, without scratching or abrading the flat surface.

In some embodiments the hand-held dusting device can include a switch 62 associated with the housing 22 for turning on the drive motor 24. Optionally, an operator can lock the switch in the "on" position to keep the duster rotating without actively holding the switch down.

In this embodiment the housing 22 captures the trigger. It is movable in a first direction between an unlocked "on" position and an "off" position, and biased toward the "off" position. It is also movable from its unlocked "on" position to a locked "on" position.

An abutment is engaged by the trigger to resist the trigger bias when the trigger is in its locked "on" position, and so it does not resist the trigger bias when the trigger is in its unlocked "on" position.

The first and second electrical contacts are normally biased apart. One of the contacts is operatively connected to the trigger, so it will close against the other contact (so the switch is "on") when the trigger is advanced from the "off" position to one of the "on" positions.

Optionally, the switch mechanism further can include a lever mechanism. The lever can have a fulcrum pivoted to the housing and first and second arms depending from the fulcrum. The first electrical contact can be operatively connected to the first arm and aligned to contact the second contact when the first arm is pivoted about the fulcrum. In certain embodiments, the trigger can operatively engaging the second arm to pivot the second arm, causing the first arm to pivot and the contacts to close, when the trigger is moved from the "off" position to one of the "on" positions.

Figure 10:
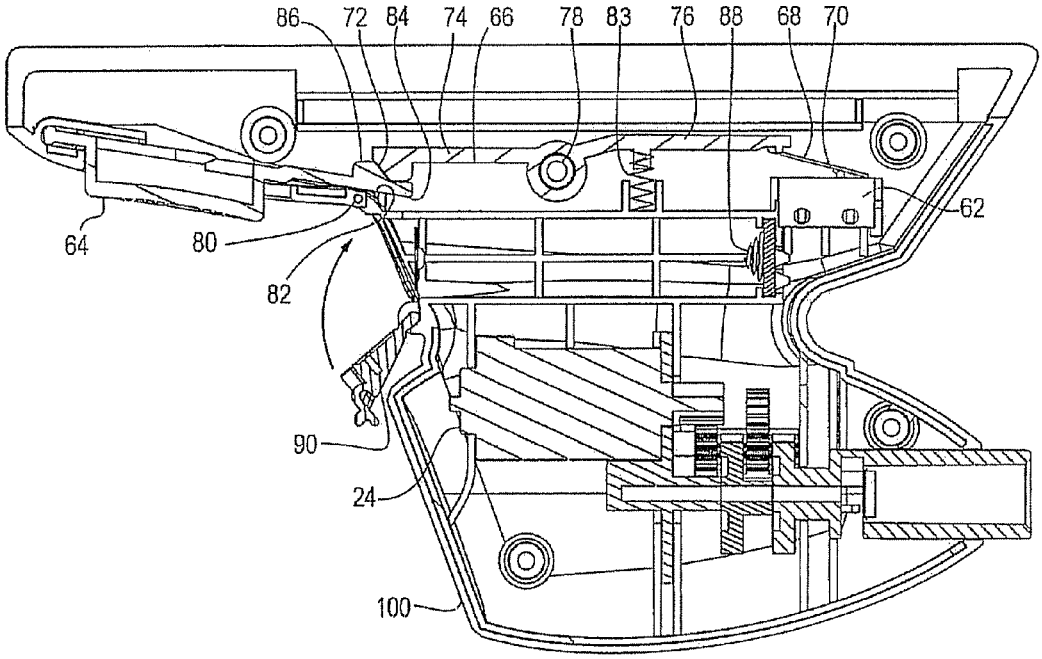
FIG. 10 is a side view, partially in section, of one half shell of the motor case, showing the battery cover open.

In the illustrated embodiment, the switch mechanism comprises a trigger 64 and a linkage defined by the levers 66 and 68 for operating the switch plunger 70 to open and close the contacts of the switch 62. The trigger 64 is captured for sliding motion generally to the left and right as shown in FIG. 10; it is shown in its "off" position in FIG. 10. The leading portion of the trigger 64 is a ramp 72. The lever 66 has a trailing arm 74, a leading arm 76, a pivot 78 and a ramp 80 on the trailing arm 74. An abutment 82, here formed by part of the housing 22, prevents downward motion of the ramp 72. First and second electrical contacts (conventional, not shown) within the switch body 62 are brought into contact, closing the switch, by depressing the plunger 70.

Figure 11:
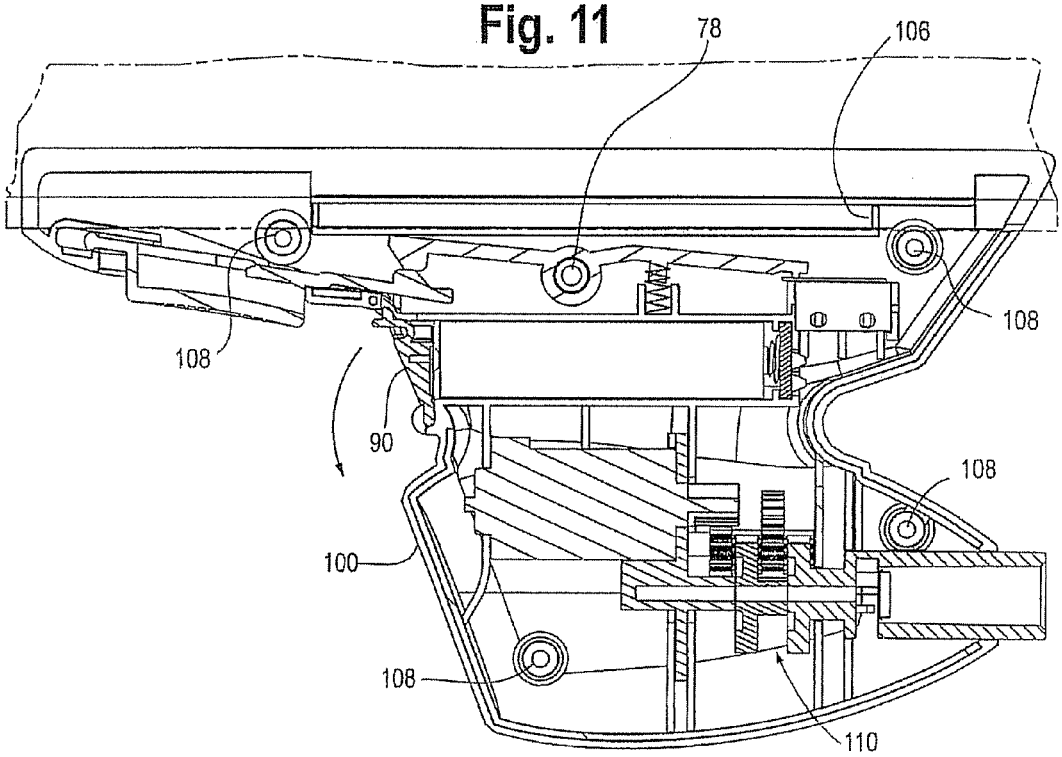
FIG. 11 is a view similar to FIG. 10, but showing the connecting structure in phantom lines and the battery cover closed.

The contacts of the switch 62 are biased apart by internal structure, thus biasing the plunger 70 out of the body of the switch 62. The trigger bias spring 84 biases the lever arm 76 up, thus the arm 74 and ramp 80 down, thus the trigger 64 and its ramp 72 to the left, as shown in FIGS. 10 and 11. When the trigger 64 is manually slid partially to the right by the operator, the travel of the ramp 72 pushes the ramp 80 upward, thus the lever 68 and plunger 70 downward, closing the switch 70 in a momentary-contact mode.

If the trigger 64 is manually slid fully to the right, it latches as the flat following surface 84 of the ramp 80 overrides the flat following surface 86 of the ramp 80, so the bias of the spring 83 is resisted by contact between the flat following surfaces 84 and 86 and the reactive force provided by the abutment 82.

The trigger 64, when latched, can be released by manually moving the trigger 62 to the left so the ramps 72 and 80 engage, allowing the bias of the spring 83 to slide the trigger 64 to the left to allow the lever arm 76, thus the lever 68 and the plunger 70, to rise, thus allowing the contacts of the switch 62 to break contact and disconnect the electricity otherwise flowing to the motor.

The device can include a battery bracket generally indicated at 88 secured to the housing 22 and electrically connected to the drive motor 24 via the switch. The battery bracket 88 is accessed through an insertion door 90, which is shown open, with the battery removed, in FIG. 10, and closed, with the battery present, in FIG. 11. The illustrated embodiment can be adapted to use various types of batteries, for example a pair of conventional or rechargeable AAA cells.

Figure 9:
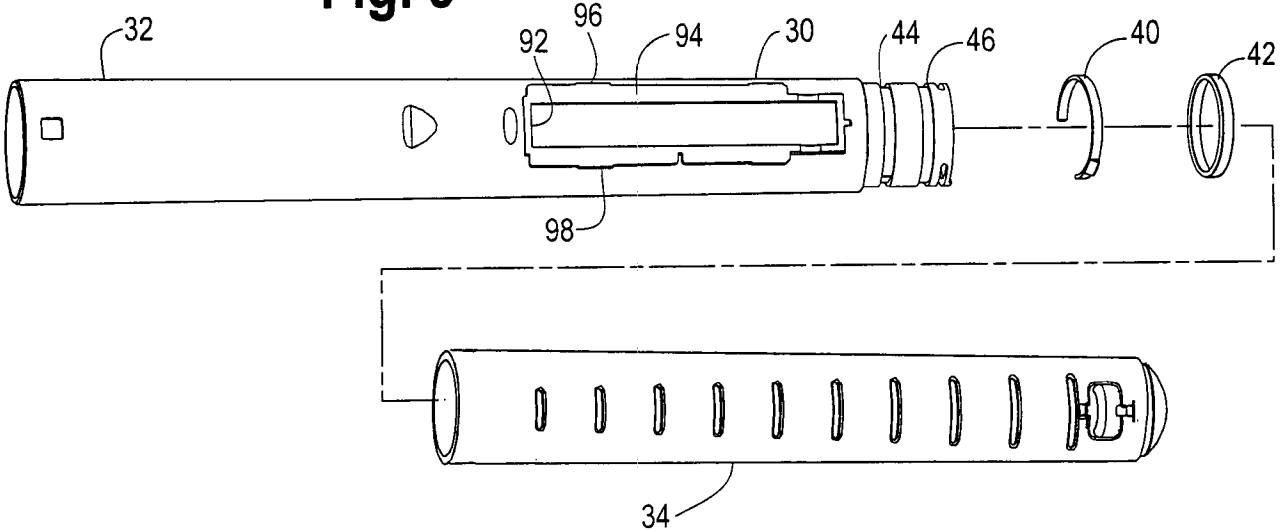
FIG. 9 is an exploded view of the structure of FIG. 8.

Another optional feature of the illustrated embodiment is the connection between the housing 22 and the conduit 30. Referring to FIG. 9, the conduit 30 has a side opening 92 defining an attachment area secured to a cleat 94. In this embodiment, the cleat 94 is formed integrally with the conduit 30, although it can also be provided as a separate part attached to the conduit 30. The cleat 94 has first and second wings 96 and 98.

The housing 22 is made of first and second mating shell portions 100 and 102 (shown best in FIG. 2) joined at a parting plane 104 that is perpendicular to the paper in the embodiment of FIG. 2. The first shell portion 100, and here also the mating second shell portion 102 (interior not shown), has a cleat slot 106 extending depthwise generally perpendicular to the parting plane.

The cleat 94 has a first portion anchored at the attachment area and a wing portion such as 98 captured in the cleat slot 106 of the shell portion 100 of the housing 22. A second cleat slot can be provided in the second shell portion, the second cleat slot extending depthwise generally perpendicular to the parting plane. The second wing portion of the cleat can be captured in the second cleat slot. Fasteners such as those generally indicated at 108, which can be mating nuts and bolts, welds, snaps, or other types of fasteners, join the shells. When the wings are assembled in the cleat slots and the shells 100 and 102 are joined together, the cleat is captured in the slots, holding the housing 22 against the conduit 100.

It will be appreciated that the housing 22 could alternatively be made integrally with the conduit 30, instead of joining them.

The drive motor is mounted within the housing 22 and operatively connected with the duster 26 to rotate the duster 26 about its axis 28.

In certain embodiments, the hand-held dusting device can be powered by an external source of power.

In some embodiments, the first portion 32 of the conduit 30 can be adapted to couple to a vacuum cleaner hose to draw air and debris into the side portion and out the first portion 32 of the conduit 30.

The duster 26 may be composed of fairly flexible fibers like one would find incorporated into a duster. Such dusters are commonly made from feather-based fibers, lambs wool based fibers, or plastic based fibers. It has also been found that the fibers may be made from threads, woven or not, that for sake of illustration are substantially similar to the fringe on an area rug. Such fibers can be made from a variety of materials from cotton to nylon. However, it has been found that synthetics such as nylon do have greater static-electricity-charging capabilities. A distinction can be drawn between the geometry and functionality of duster fibers, and the bristles of a brush. A duster's fibers can function as follows: as the relatively flexible fibers come into contact with a surface to be cleaned, the sides of the fibers grab the dust or debris. Contrast this with the action of brush rolls on a vacuum cleaner, or a household broom. In these situations it is the ends of relatively stiff bristles that serve to flick or brush directionally the debris. And so the sides of the fibers might have no functionality except to geometrically connect the ends of the brush elements to the rest of the device, and to flex only enough for the flicking action and to compensate for surface interference. So the fibers of a duster commonly are relatively flexible so that extremely little force is required to cause their lengths to flatten against the surface to be cleaned, as opposed to the types of bristles used in traditional brush-rolls and the like. Another related distinction between traditional brush rolls on a vacuum cleaner and the disclosed duster regards the length of the cleaning elements. The effective length of the bristles used in brush rolls is generally ½" or less. Some embodiments of the disclosed duster have fibers greater than 1 inch (2 cm) long. Again this goes to flexibility, so that the sides of the fibers can be used for cleaning. And this flexibility is also useful to conform to irregular surfaces of objects (such as picture frames, piano keys, glass ware and the like) without pushing these very same objects around.

Optionally, a vacuum air pump could either be an integral part of the illustrated embodiment, or a separate source of vacuum, which may be in fluid communication with the illustrated embodiment.

The operation of the device is as follows. The vacuum conduit 30 is either in close proximity to the duster 26, so that dust and debris may be removed from the duster 26 by a vacuum air pump, or the vacuum conduit 30 is in active frictional engagement or interfering relation with the fibers of the duster 26, so the vacuum conduit 30 acts as a comb or shear to loosen the dust and debris from the duster 26 as the fibers contact the conduit 30. The vacuum air pump may then remove the dust and debris from the area. Active frictional engagement may also reduce the amount of negative vacuum pressure necessary to remove the debris from the fibers. Centrifugal force, caused by the spinning action of the duster 26, may also aid in bringing the fibers or pick-up elements of the duster 26 into the air flow region of the device, or into the active frictional engagement that has already been described. The movement of the duster 26 may be continuous while cleaning or intermittent with the user only pulsing the unit on for intermittent cleaning of the duster. And so speed of rotation is not very critical, in other words the movement of the duster can be quite slow, however, it has been found that the user feels it is working best when it is moving at least 20 rpm. It should also be appreciated that if the duster moves too quickly, the flailing of the fibers can fan dust away before it has been picked up. This generally seems to occur at speeds greater than 250 rpm.

The switch may be reversible to further aid in the versatility of the unit's cleaning ability. Additionally, the duster may have a static charge imparted on it throughout the process via frictional or electrically driven means.

Again, all previously described embodiments may be powered through conventional means such as a motor and associated gearing and/or belt drives. For example, in the illustrated embodiment the duster 26 is mechanically connected to the motor 24 by a reduction gear set generally indicated at 110. The motor could be electrical in nature, a mechanical wind-up spring driven motor, or an air-turbine motor powered by an on board or separate, external air movement device such as a vacuum fan. And so a variety of novel tools have been disclosed.

What is claimed is:

1. A hand held device for dusting a surface, the device comprising:

A. a housing;

B. a drive motor associated with the housing;

C. a duster having an axis of rotation, a first end, and an axially spaced second end, the duster being rotated about its axis by the drive motor;

D. at least one conduit operatively associated with the housing and having a first portion for attachment to a source of vacuum, and a side portion extending coaxial with the first portion, parallel to the axis of the duster and adjacent to the duster, the side portion having a vacuum inlet extending along the length of the duster for drawing dirt from the duster; the vacuum inlet being selectively rotatable from a first position generally facing toward the duster to a second position generally facing away from the duster, the second position providing access to the vacuum inlet independent of the duster; and E. a rotating coupling between the first portion and the side portion, the coupling connecting the first and side portions to each other while simultaneously allowing the side portion to rotate about an axis extending generally parallel to the axis of the duster;

the device weighing less than five pounds.

2. The hand-held dusting device of claim 1, wherein the conduit has a distal end.

3. The hand-held dusting device of claim 2, further comprising a roller mounted adjacent to the distal end and positioned to make rolling contact with a surface near the surface being dusted.

4. The hand-held dusting device of claim 1, further comprising a rotating seal between the first portion and the side portion, the seal being adapted to allow a partial vacuum to be drawn from the side portion to the first portion to convey dust from the side portion to the first portion of the conduit.

5. The hand-held dusting device of claim 1, further comprising a detent associated with the coupling for maintaining the side portion in at least one detent position relative to the first portion of the conduit.

6. The hand-held dusting device of claim 5, wherein said detent is configured to retain the vacuum inlet of the side portion in a position generally facing toward the duster.

7. The hand-held dusting device of claim 5, wherein said detent is configured to retain the vacuum inlet of the side portion in a position facing generally away from the duster.

8. The hand-held dusting device of claim 5, wherein said detent is configured to retain the vacuum inlet of the side portion in a position facing a direction rotationally displaced from the axis of the duster.

9. The hand-held dusting device of claim 1, further comprising a switch mechanism associated with the housing for actuating the drive motor.

10. The hand-held dusting device of claim 9, wherein the switch mechanism comprises a lock to hold the switch in the "on" position to keep the duster rotating.

11. The hand-held dusting device of claim 9, wherein the switch mechanism comprises:

A. a trigger captured by the housing, movable in a first direction between an unlocked "on" position and an "off" position, biased from the unlocked "on" position toward the "off" position, and movable from its unlocked "on" position to a locked "on" position;

B. an abutment engaged by the trigger to resist the bias when the trigger is in its locked "on" position, and not to resist the bias when the trigger is in its unlocked "on" position; and C. first and second electrical contacts normally biased apart, one of the contacts being operatively connected to the trigger to be closed against the other contact when the trigger is advanced from the "off" position to one of the "on" positions.

12. The hand-held dusting device of claim 11, wherein the switch mechanism further comprises a lever comprising a fulcrum pivoted to the housing, first and second arms depending from the fulcrum, the first electrical contact operatively connected to the first arm and aligned to contact the second contact when the first arm is pivoted about the fulcrum, and the trigger operatively engaging the second arm to pivot the second arm, causing the first arm to pivot and the contacts to close, when the trigger is moved from the "off" position to one of the "on" positions.

13. The hand-held dusting device of claim 1, further comprising a battery bracket secured to the housing and electrically connected to the drive motor.

14. The hand-held dusting device of claim 1, wherein the first portion of the conduit is adapted to couple to a vacuum cleaner hose to draw air and debris into the side portion and out of the first portion of the conduit.

15. The hand-held dusting device of claim 1, further comprising:

A. a housing comprising first and second shell portions joined at a parting plane, wherein the first shell portion has a cleat slot extending depthwise generally perpendicular to the parting plane; and B. a cleat supported by the conduit and having a wing portion captured in the cleat slot.

* * * * *

UNITED STATES PATENT AND TRADEMARK OFFICE

CERTIFICATE OF CORRECTION

PATENT NO. : 7,594,298 B2
APPLICATION NO. : 11/059852
DATED : September 29, 2009
INVENTOR(S) : Mason I. Greene It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1158 days.

Signed and Sealed this

Twenty-eighth Day of September, 2010

David J. Kappos

David J. Kappos
*Director of the United States Patent and Trademark Office*